United States Patent [19]

Yoshioka et al.

[11] 4,053,449

[45] Oct. 11, 1977

[54] FAST-IDLE CAM APPARATUS IN A CARBURETOR

[75] Inventors: Yuichi Yoshioka, Asaka; Tsugio Sanka, Wako, both of Japan

[73] Assignees: Honda Giken Kogyo Kabushiki Kaisha, Tokyo; Kabushiki Kaisha Keihin Seiki Seisakusho, Kawasaki, both of Japan

[21] Appl. No.: 660,029

[22] Filed: Feb. 20, 1976

[30] Foreign Application Priority Data

Feb. 26, 1975 Japan ..... 50-25431

[51] Int. Cl.[2] ..... F02M 1/02

[52] U.S. Cl. ..... 261/44 R; 261/52

[58] Field of Search ..... 261/52, 44 R

[56] References Cited

U.S. PATENT DOCUMENTS

| | | | |
|---|---|---|---|
| 1,975,432 | 10/1934 | Piat | 261/44 R |
| 2,124,777 | 7/1938 | Hunt et al. | 261/52 |
| 3,151,189 | 9/1964 | McSeveny | 261/52 |
| 3,291,462 | 12/1966 | Mennesson | 261/52 |
| 3,575,389 | 4/1971 | Goto et al. | 261/52 |

FOREIGN PATENT DOCUMENTS

| | | | |
|---|---|---|---|
| 787,264 | 7/1935 | France | 261/52 |

*Primary Examiner*—Tim R. Miles

*Attorney, Agent, or Firm*—Haseltine, Lake & Waters

[57] ABSTRACT

A fast-idle cam apparatus in a carburetor having an opening and closing control for forcibly opening and closing a throttle valve, and a mechanism for moving a choke valve and the throttle valve together during engine starting at low temperature, a spring mechanism being interposed in the mechanism so that closing direction movement of the throttle valve can be absorbed therein.

8 Claims, 3 Drawing Figures

FAST-IDLE CAM APPARATUS IN A CARBURETOR

DETAILED EXPLANATION OF INVENTION

This invention relates to a fast-idle cam apparatus in a carburetor having a forcedly opened and closed throttle valve and it has for its object to provide an apparatus as above wherein a mechanism for moving together a choke valve and the throttle valve together on engine starting at a low temperature is provided and a spring mechanism is interposed therein for absorbing a closing directional movement stroke of the throttle valve thereby preventing lowering of the engine brake effect during driving of a vehicle while the engine is being warmed-up.

One embodying example of this invention will now be described with reference to the accompanying, wherein drawings.

Figure 1:
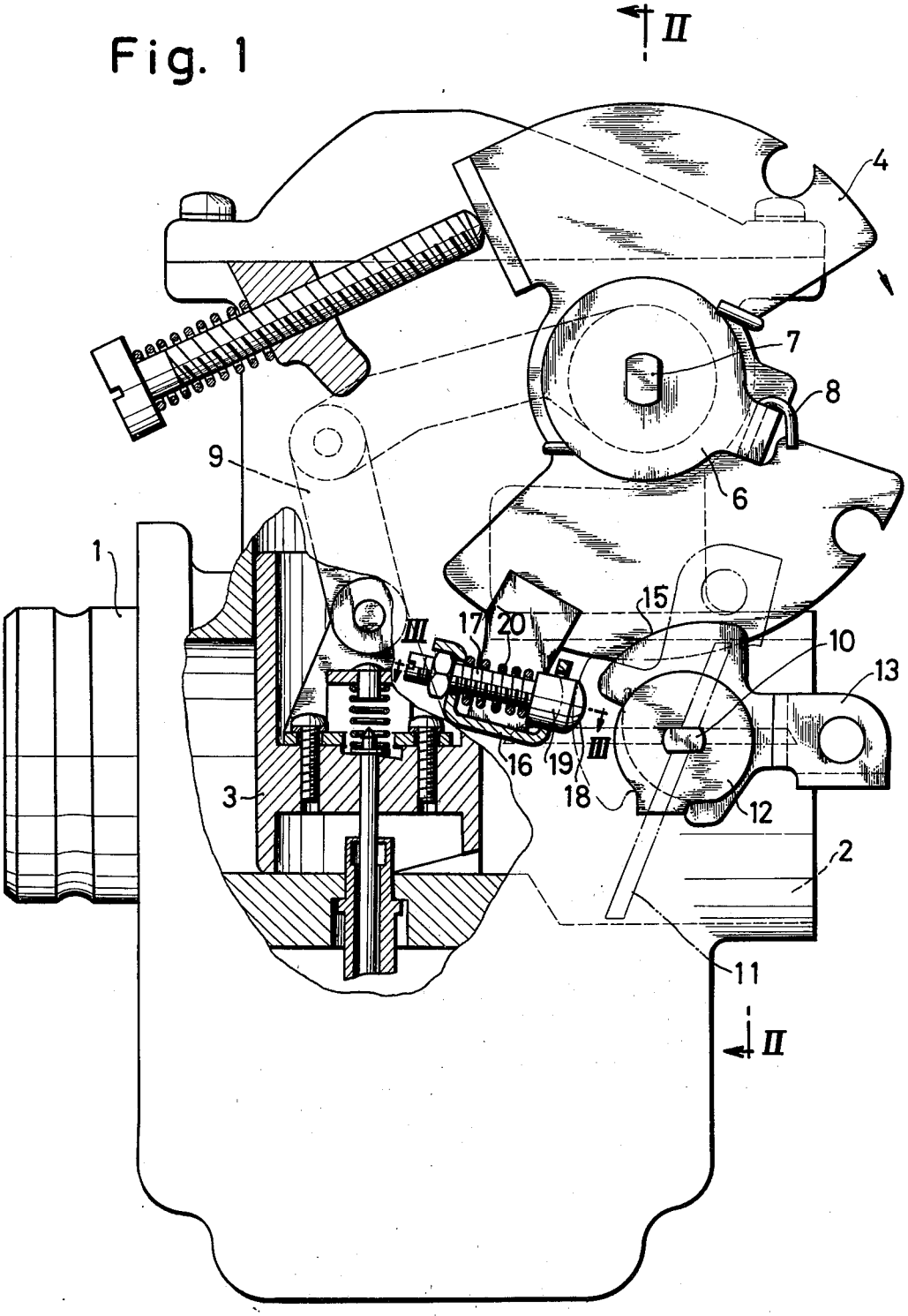
FIG. 1 is a front view, partly in section, of one embodiment of this invention.
Figure 2:
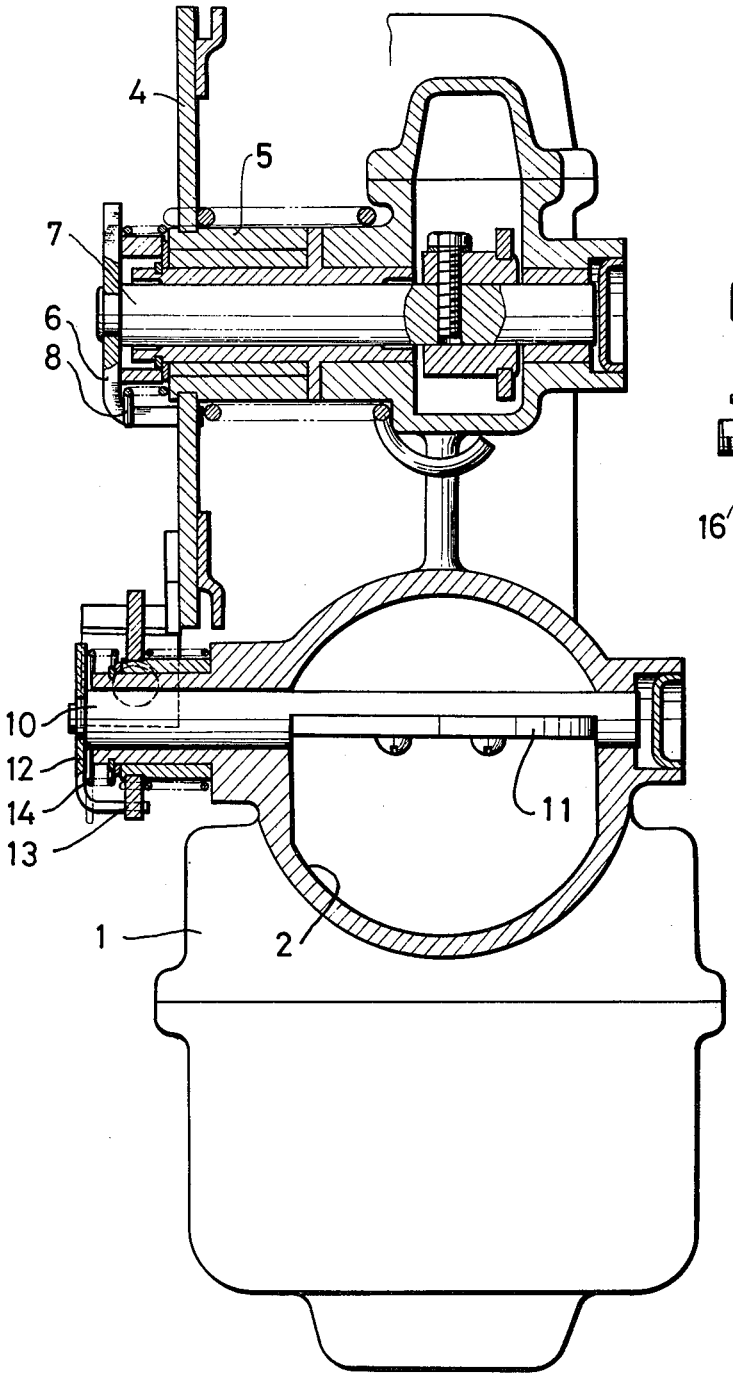
FIG. 2 is a sectional side view taken along line II - II in FIG. 1.
Figure 3:
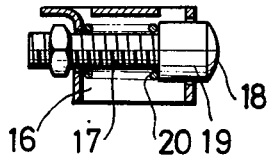
FIG. 3 is a sectional side view taken along line III - III in FIG. 1.

Numeral 1 denotes a carburetor body, numeral 2 denotes an intake passage, numeral 3 denotes a slidable throttle valve, numeral 4 denotes a throttle valve opening and closing disc forcibily turnable by a throttle operation mechanism (not illustrated), numeral 5 denotes a turnable supporting shaft of the disc 4, numeral 6 denotes a throttle valve lever which is secured to a turnable throttle valve shaft 7 and lever 6 is in engagement with the throttle valve opening and closing drum 4 through a spring 8 and numeral 9 denotes a link mechanism for converting a turning force of the throttle valve opening and closing disc 4 to upward and downward movements of the slidable throttle valve 3.

Numeral 10 denotes a choke valve shaft, numeral 11 denotes a choke valve, numeral 12 denotes a choke lever secured to the choke valve shaft 10, and numeral 13 denotes a choke operation lever which is rotatably supported on the choke valve shaft 10 coaxially therewith and is in engagement through a relief spring 14 with the foregoing choke lever 12 and is formed at a portion thereof into a fast-idle cam 15. Numeral 16 denotes a spring mechanism holding portion formed on a radial projection on the outer periphery of the throttle valve opening and closing disc 4, and it supports a spring mechanism including a pin 19 having a threaded portion 17 and a head portion 18 retractable against the action of a spring 20, the maximum projecting position of the head portion 18 being adjustable by means of a nut.

This apparatus having the above construction operates as follows:

For an engine starting operation at a low temperature, if the choke operation lever 13 is turned in the counterclockwise direction in the drawing, the choke valve 11 is closed. The fast-idle cam 15 formed on the choke operation lever 13 is brought into pressure contact with the head portion 18 of the pin 19. At this time, the valve opening and closing mechanism for the throttle valve is due to the location of the fast idle cam 15 therefore this pushing of the fast idle cam 25 serves to rotate disc 4 in the valve opening direction and the spring 20 is not deformed. By this rotation of drum 4, the throttle valve 3 is slightly opened by a predetermined amount through the spring 8, the throttle valve lever 6, the throttle valve shaft 7 and the link mechanism 9, whereby it is prepared for the engine starting operation at a low temperature.

Though a predetermined time is necessary for the engine to be warmed up after engine starting, it is often required, in practice, to drive the vehicle immediately after engine starting under the condition that the choke valve 11 is closed. Even if a counter measure is taken to select properly a load of the relief spring 14, due to the location of the fast idle cam 15 the throttle valve is kept opened by a predetermined open degree, so that engine brake effect is lowered and thus special care for safe driving must be taken during engine warm-up.

According to the invention, however, where an engine brake effect is required, the valve opening and closing mechanism is operated by the driver in its valve closing direction for closing the throttle valve. Hence, drum 4 is under a force in its valve closing direction, and is of such a magnitude so that drum 4 rotates in that direction and the spring 20 which is previously selected to have a load weaker than this operational force is deformed (compressed). The throttle valve may again be closed even if the fast idle cam 15 is in its operating position.

After warming-up of the engine, the choke valve opened up, the choke operation lever 13 is operated by the driver in its opening direction, the choke valve 11 is returned to its full open position, and at the same time the fast-idle cam 15 is removed from its contact with the head portion 18 of the pin 19, and the spring 20 is free to expand, whereby ordinary throttle valve opening and closing conditions are attained.

Thus, according to this invention, there is an advantage that the engine brake effect is not different from that obtained in ordinary driving conditions while the engine is warming up and the safety characteristic is improved. In the case where the spring mechanism is provided on the outer periphery of the throttle valve opening and closing disc as in the embodiment, it has the advantage that, from a point of view of the relation of arm ratio, the operation force on the choke operation lever becomes small. Additionally, in the case where the spring mechanism holding portion is formed as a channel-shaped one as illustrated, it has the advantage that the same can be made of small-size, and in the case where the throttle valve opening and closing disc and the spring mechanism holding portion are integrally formed by pressing, it has the advantage that the cost thereforcan be lowered.

We claim:

1. A fast-idle cam apparatus for a carburetor having a throttle valve, a choke valve, and a mechanism for opening an closing the throttle valve, said fast-idle cam apparatus comprising means for moving the choke valve and the throttle valve together to respective initial positions for engine starting at low temperature, said choke valve being closed in its initial position, said throttle valve being open in its initial position, and a spring mechanism interposed in the moving means for absorbing closing movement of the throttle valve while the choke valve remains in its initial position, said choke valve including an operation lever with a fast-idle cam portion thereon, said moving means acting on said fast-idle cam portion, said choke valve being openable by said operation lever for ordinary driving conditions.

2. Apparatus as claimed in claim 1 wherein the mechanism for opening and closing the throttle valve includes turntable disc, and moving means being coupled to said disc.

3. Apparatus as claimed in claim 1, wherein said spring mechanism is interposed between said operation lever and said throttle valve, said mechanism including means for forcibly opening and closing said throttle valve.

4. Apparatus as claimed in claim 1 wherein said moving means includes a radial projection on said disc, and a displaceable member carried by said projection for acting on said fast-idle cam portion, said spring mechanism acting between said projection and said displaceable member.

5. Apparatus as claimed in claim 4 wherein said radial projection is of channel form.

6. Apparatus as claimed in claim 5 wherein said radial projection is integrally secured to said disc.

7. Apparatus as claimed in claim 4 wherein said displaceable member is threaded and includes a head for bearing against said fast-idle cam portion and an adjustment nut threaded on said displaceable member.

8. Apparatus as claimed in claim 7 wherein said spring mechanism includes a spring bearing against said head and said projection.

* * * * *